US006443447B1

(12) United States Patent
Ifkovits et al.

(10) Patent No.: US 6,443,447 B1
(45) Date of Patent: Sep. 3, 2002

(54) METHOD AND DEVICE FOR MOVING CUT SHEETS IN A SHEET ACCUMULATING SYSTEM

(75) Inventors: Edward M Ifkovits, New Fairfield; Joseph F. Zuzick, Jr., Naugatuck, both of CT (US); Douglas P. Sprenger, Hyde Park, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/752,364

(22) Filed: Dec. 29, 2000

(51) Int. Cl.[7] ..... B65H 5/00

(52) U.S. Cl. ..... 271/225; 271/184; 271/185; 271/202; 271/270; 270/52.09

(58) Field of Search ..... 83/408, 155.1, 83/155; 270/52.07, 52.08, 52.09; 271/225, 184, 185, 279, 298, 303, 9.13, 202, 270

(56) References Cited

U.S. PATENT DOCUMENTS 4,273,319 A * 6/1981 Stocker ..... 270/21.1
5,439,208 A * 8/1995 Moser et al. ..... 271/182
5,538,240 A * 7/1996 Auerbach et al. ..... 271/186
5,575,465 A * 11/1996 Auerbach et al. ..... 198/452
5,664,772 A 9/1997 Auerbach et al. ..... 271/225
6,092,802 A * 7/2000 Lackner et al. ..... 271/225
6,109,603 A * 8/2000 Stevens et al. ..... 270/52.07
6,125,730 A * 10/2000 Jacques ..... 270/52.09
6,378,861 B1 * 4/2002 Middelberg et al. ..... 270/52.09

* cited by examiner

*Primary Examiner*—Christopher P. Ellis
*Assistant Examiner*—Patrick Mackey
(74) *Attorney, Agent, or Firm*—Michael J. Cummings; Angelo N. Chaclas

(57) ABSTRACT

A method and device for improving the stacking efficiency in a sheet accumulation system using a continuous web cutter for cutting a web of material into sheets and a plurality of right angle turn-over modules for changing the direction of the sheets and causing overlapping between adjacent sheets. Different movement mechanisms are used to move the sheets with different moving speeds from the web cutter toward the right angle turn-over modules for increasing the overlapped amount.

7 Claims, 8 Drawing Sheets

METHOD AND DEVICE FOR MOVING CUT SHEETS IN A SHEET ACCUMULATING SYSTEM

FIELD OF THE INVENTION

The present invention relates generally to a sheet accumulating system and, more particularly, to a continuous web cutter for providing cut sheets and a right angle transport device for stacking the cut sheets.

BACKGROUND OF THE INVENTION

Continuous web cutters are known in the art. Typically, a continuous web cutter is used to cut a continuous web of material into cut sheets, provide the cut sheets to a sheet accumulator and then to an insertion station in a mass mailing inserting system. As shown in FIG. 1, a continuous web of material with sprocket holes on both side of the web is fed from a fan-fold stack into the web cutter, which has two moving belts with sprockets (or tractors with pins) to move the web toward a guillotine cutting module for cutting the web cross-wise into separate sheets. Perforations are provided on each side of the web so that the sprocket hole sections of the web can be removed from the sheets prior to moving the cut sheets to other components of the mailing inserting system. In particular, the continuous web cutter, as shown in FIG. 1, is used to feed two webs of material linked by a center perforation. As shown, a splitter is used to split the linked webs into two separate webs before the webs are simultaneously cut by the cutting module into two cut sheets. The sheets are moved toward a right angle transport device so that the sheets are moved in a different direction, overlapping each other. Right angle transport devices are well known. For example, in U.S. Pat. No. 5,664,772, Auerbach et al. disclose a right angle transport device having two or more sheet turn-over modules, wherein the turn-over modules are placed at 45 degrees in the path of two or more sheets moving in a side-by-side fashion so that these sheets are turned over while their moving direction is changed by 90 degrees. As such, the sheets are moving substantially along the same line, with one sheet leading another in an overlapping manner. The overlapped mount by the two sheets using this type of right angle transport device is determined by the difference between the length and the width of the sheets. If the difference between the length and the width of the sheets is small, the overlapping between the two cut sheets may cause a paper jam when the sheets are collated into a stack in the sheet accumulator. Furthermore, with a small overlapped amount, a longer stacking mechanism must be used to collate the overlapped sheets into the stack. If the sheets are square or the length of the sheet is smaller than the width, then there is no overlapping when the sheets emerge from the right angle transport device.

It is advantageous and desirable to provide a method and device to increase the overlapped amount of the cut sheets as they exit the right angle transport device.

SUMMARY OF THE INVENTION

It is the primary object of the present invention to increase the overlapped amount of cut sheets in a continuous web cutter and a right angle transport device so as to increase the collating efficiency of a sheet accumulator. Accordingly, the first aspect of the invention is a continuous web cutter for cutting a web of material into groups of cut sheets, wherein each group of cut sheets comprises at least a first sheet and a second sheet, and wherein the first and second sheets are moved in a side-by-side fashion from the web cutter toward a right angle transport device for causing the first and second sheets to turn over while their moving direction is changed from a first direction to a second direction substantially perpendicular to the first direction, with the first sheet leading the second sheet in an overlapping manner, with an overlapped amount along the second direction. The web cutter comprises a first movement mechanism for moving the first sheet toward the right angle transport device with a first moving speed, and a second movement mechanism for moving the second sheet toward the right angle transport device with a second moving speed greater than the first moving speed for increasing the overlapped amount.

The second aspect of the present invention is a method of stacking sheets in a sheet accumulating system, including a right angle transport device, to change moving direction of sheets from a first direction to a second direction substantially perpendicular to the first direction, and a continuous web cutter for cutting a web of material into groups of cut sheets, wherein each group of cut sheets comprises at least a first sheet and a second sheet, and wherein the first and second sheets are moved substantially in a parallel fashion along the first direction from the web cutter toward the right angle transport device for causing the first and second sheets to turn over and move along the second direction, with the first sheet leading the second sheet in an overlapping fashion having an overlapped amount along the second direction. The method comprises the steps of providing a first movement mechanism for moving the first sheet with a first moving speed, and providing a second movement mechanism for moving the second sheet with a second moving speed greater than the first moving speed for increasing the overlapped amount.

The third aspect of the present invention is a sheet accumulating system, which comprises a right angle transport device to change moving direction of sheets from a first direction to a second direction substantially perpendicular to the first direction; a continuous web cutter for cutting a web of material into groups of cut sheets, wherein each group of cut sheets comprises at least a first sheet and a second sheet, and wherein the first and second sheets are moved along the first direct from the web cutter toward the right angle transport device for causing the first and second sheet to turn over and move along the second direction with the first sheet leading the second sheet in an overlapping fashion having an overlapped amount in the second direction; a first movement mechanism for moving the first sheet with a first moving speed; and a second movement mechanism for moving the second sheet with a second moving speed greater than the first moving speed for increasing the overlapped amount.

The present invention will become apparent upon reading the description taken in conjunction with FIGS. 2 to 8.

DETAILED DESCRIPTION

Figure 1:
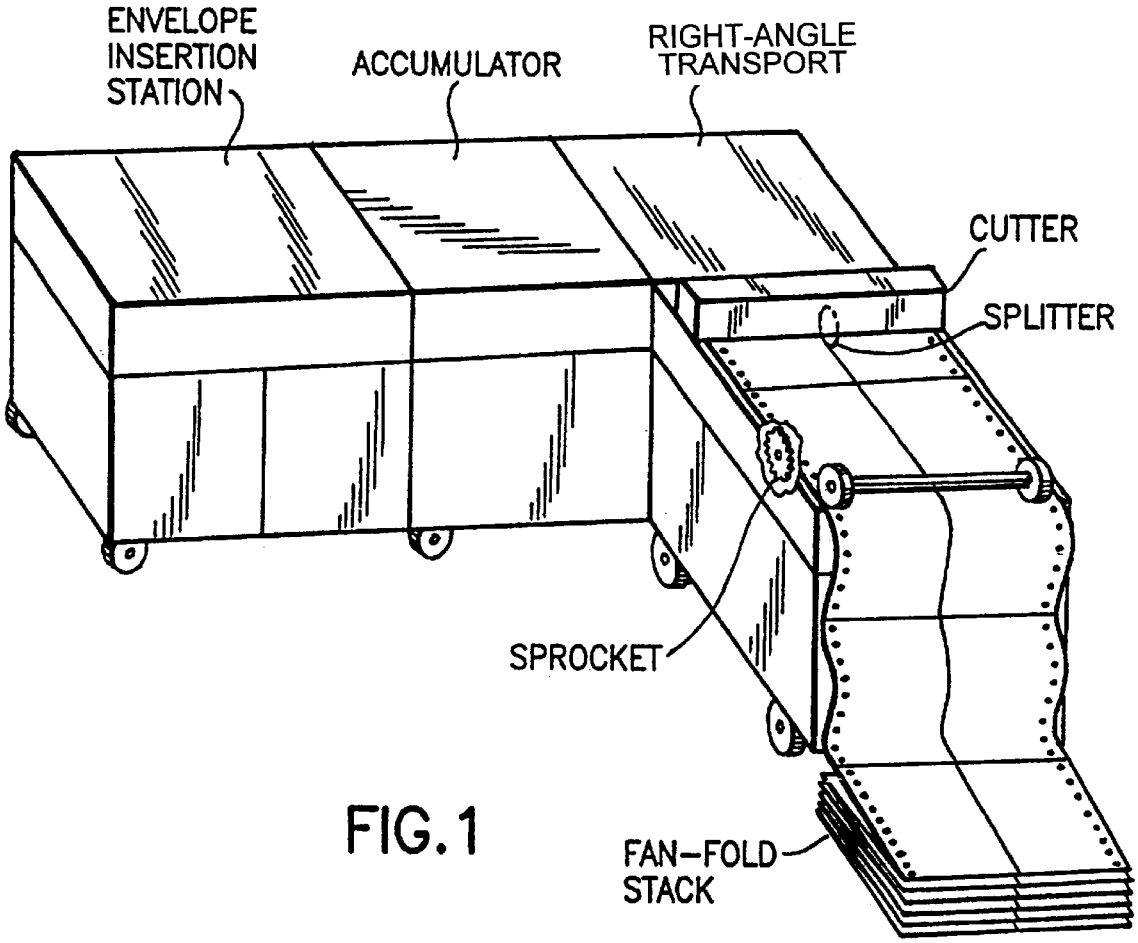
FIG. 1 is a perspective view of a mass mailing inserting machine using a continuous web cutter to cut a web of material into separate sheets.
Figure 2:
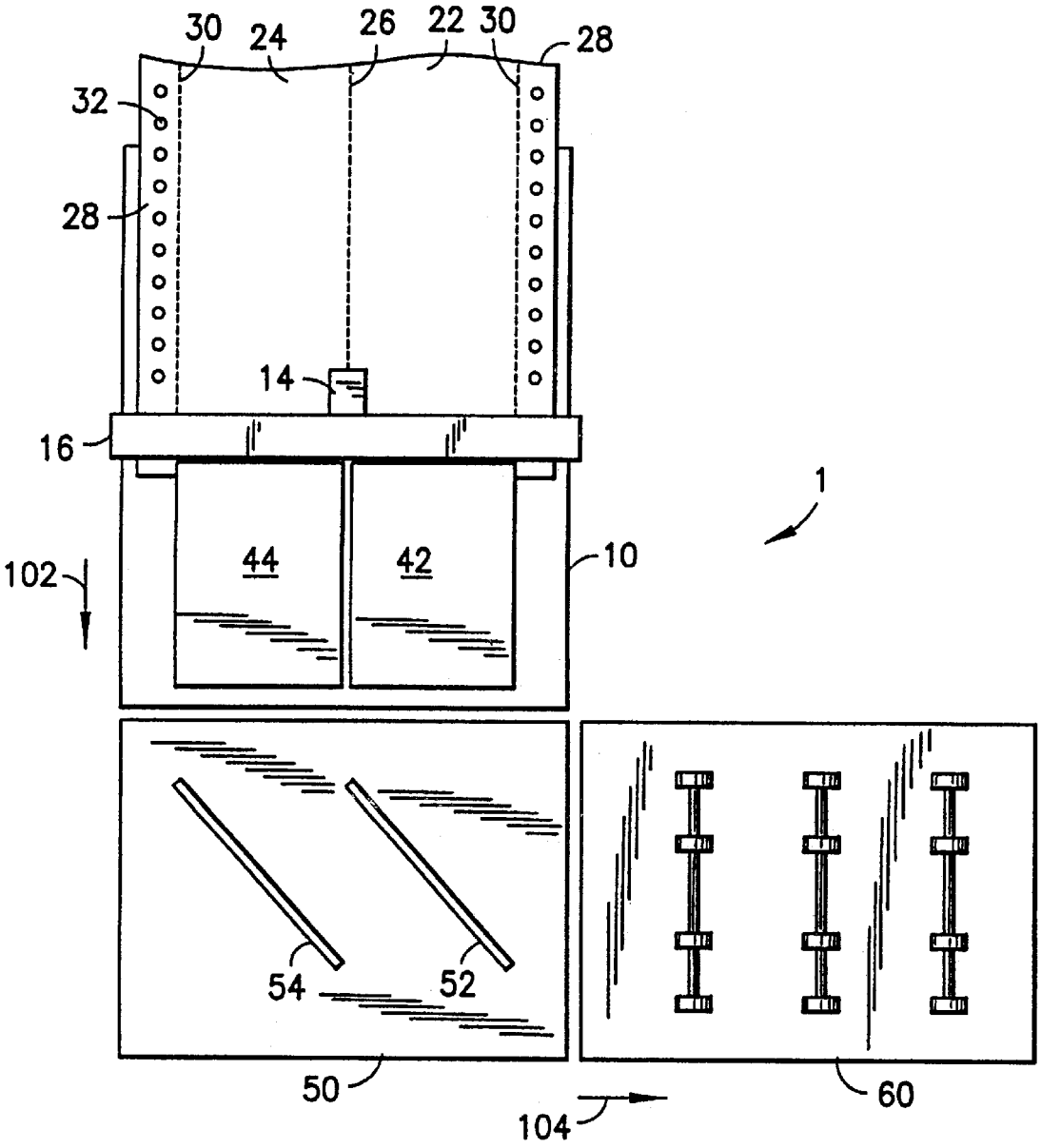
FIG. 2 is a diagrammatic representation showing the top view of the continuous web cutter, a right angle transport device and a sheet accumulator.

Referring to FIG. 2, a sheet accumulating system 1 includes a continuous web cutter 10 for feeding two webs of material 22, 24 linked by a center perforation 26 so that the webs can be simultaneously cut into sheets 42, 44 by a cutting module 16. The webs 22, 24 are also linked to side strips 28 by perforations 30. The side strips 28 have a plurality of holes 32 for feeding into the web cutter 10 by sprockets or tractor pins 12. As shown in FIG. 2, a splitter 14 is used to separate part of the connected webs 22, 24 before they are cut into separate sheets 42, 44. The sheets 42, 44 are moved along a first direction 102 toward a right angle transport device 50 in a side-by-side fashion. The right angle transport device 50 has two sheet turn-over modules 52, 54 placed at 45 degrees in the path of the incoming sheets 42, 44 so that the sheets 42, 44 are turned over and moved along a second direction 104 toward a sheet accumulator 60 for collation.

Figure 3A:
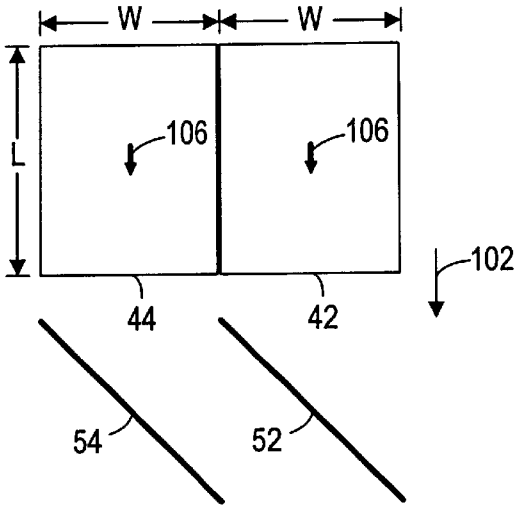
FIG. 3*a* is a diagrammatic representation showing the position of two sheets moving toward the right angle transport device at the same speed after being cut by the web cutter.
Figure 3B:
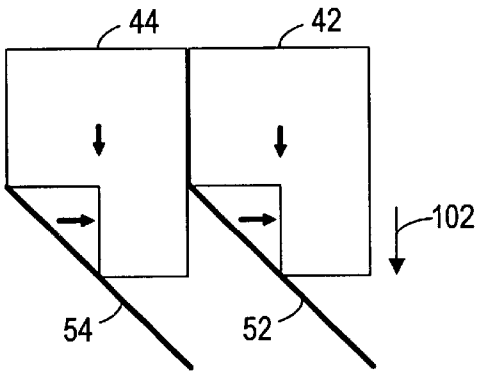
FIG. 3*b* is a diagrammatic representation showing the position of two sheets engaged with the right angle transport device.
Figure 3C:
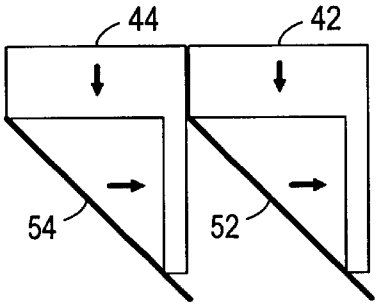
FIG. 3*c* is a diagrammatic representation showing the position of two sheets further engaged with the right angle transport device.
Figure 3D:
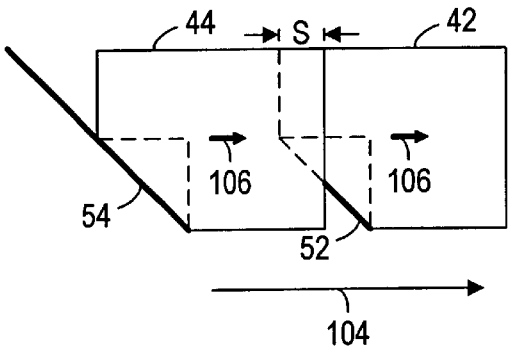
FIG. 3*d* is a diagrammatic representation showing the overlapping of two sheets as they exit the right angle transport device.
Figure 3E:
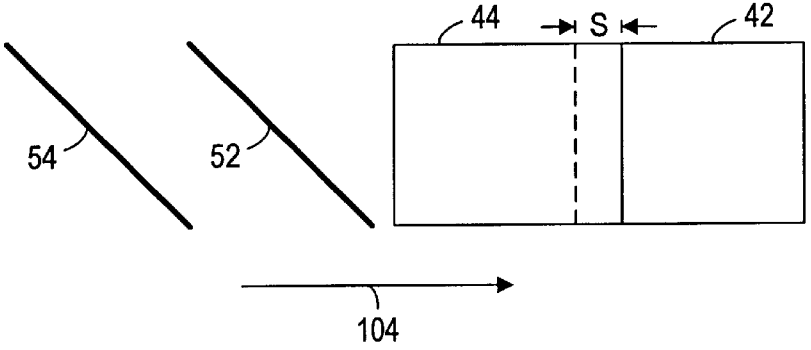
FIG. 3*e* is a diagrammatic representation showing the two overlapped sheets, which have disengaged themselves from the right angle transport device.

Conventionally, sheets 42, 44 are moved at the same speed toward the sheet turnover modules 52, 54 along the first direction 102, as shown in FIG. 3*a*. The moving speed is represented by arrow 106. The length of the sheets 42, 44 is denoted by the letter L and the width is denoted by the letter W. As shown in FIG. 3*b*, part of the sheets 42, 44 are turned over by the turn-over modules 52, 54, and the turned over sections are moved along the second direction 104, which is substantially perpendicular to the first direction 102. FIG. 3*c* shows that the sheets 42, 44 are further engaged with the turn-over modules 52, 54. Because they are moved at the same speed, the sheets 42, 44 are turned over by the same amount. As the sheets 42, 44 emerge from the turn-over modules 52, 54, they move substantially on the same line along the second direction 104 with the sheet 42 leading the sheet 44, and they are partially overlapped by an amount S, as shown in FIG. 3*d*. The overlapped amount S is substantially equal to the difference between L and W. When the sheets 42, 44 are completely disengaged from the turn-over modules 52, 54, they are overlapped by the same amount S, as shown in FIG. 3*e*, if they are not moved by another moving mechanism in a different way.

Figure 4A:
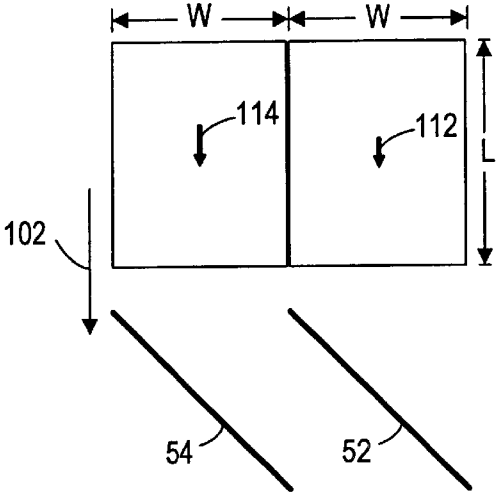
FIG. 4*a* is a diagrammatic representation showing the position of two sheets moving toward the right angle transport device at different speeds after being cut by the web cutter.
Figure 4B:
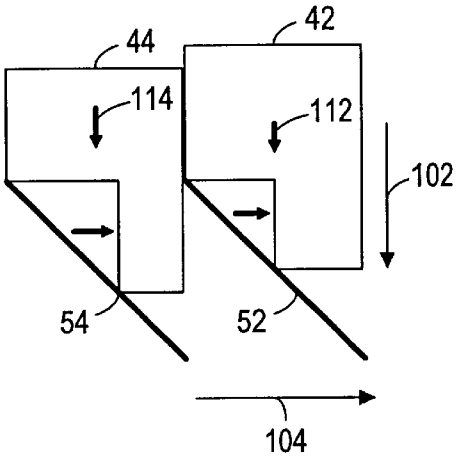
FIG. 4*b* is a diagrammatic representation showing the different positions of the sheets as they are engaged with the right angle transport device.
Figure 4C:
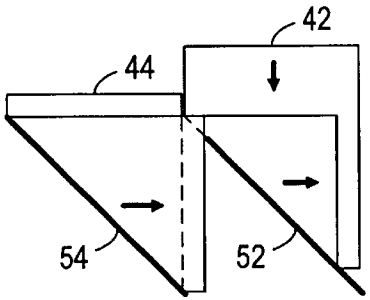
FIG. 4*c* is a diagrammatic representation showing the different positions of the sheets as they are further engaged with the right angle transport device.
Figure 4D:
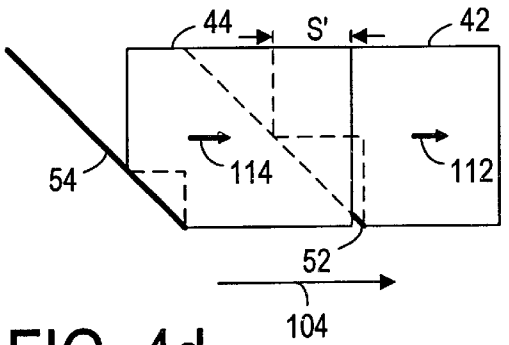
FIG. 4*d* is a diagrammatic representation showing the overlapping of the sheets as they exit the right angle transport device.
Figure 4E:
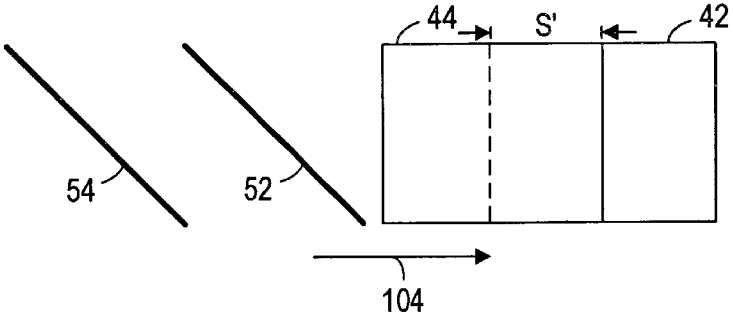
FIG. 4*e* is a diagrammatic representation showing the increased overlapped amount due to the different moving speeds of the sheets.

FIGS. 4*a*–4*e* illustrate the method of moving the sheets 42, 44, according to the present invention. The sheets 42, 44 are moved toward the turn-over modules 52, 54 with different speeds. As shown in FIG. 4*a*, the sheet 42 is moved at a first speed 112 and the sheet 44 is moved at a second speed 114, which is greater than the first speed 112. As a result, the sheet 44 is turned over faster than the sheet 42, as shown in FIGS. 4*b* and 4*c*. As the sheets 42, 44 emerge from the turn-over modules 52, 54, they are overlapped with each other with an amount S', which is greater than the difference between L and W, as shown in FIGS. 4*d* and 4*e*. Thus, even with square sheets or sheets with L smaller than W, the right angle transport device 40 (FIG. 2) can still be used for sheet collation. It is understood that the overlapped amount S' can be adjusted by adjusting the difference between the second speed 114 and the first speed 112.

Figure 5A:
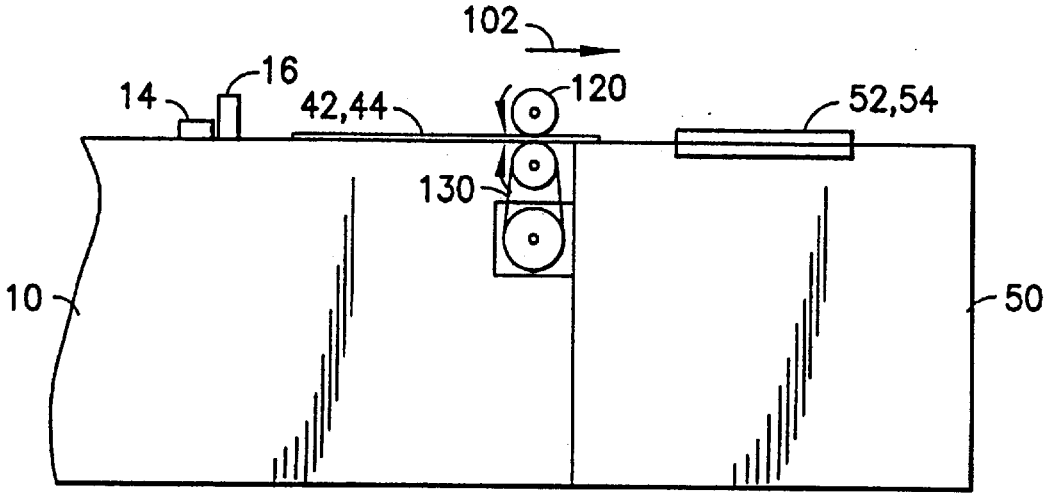
FIG. 5*a* is a diagrammatic representation showing the side view of the web cutter having a movement mechanism for moving the sheets toward the right angle transport device.
Figure 5B:
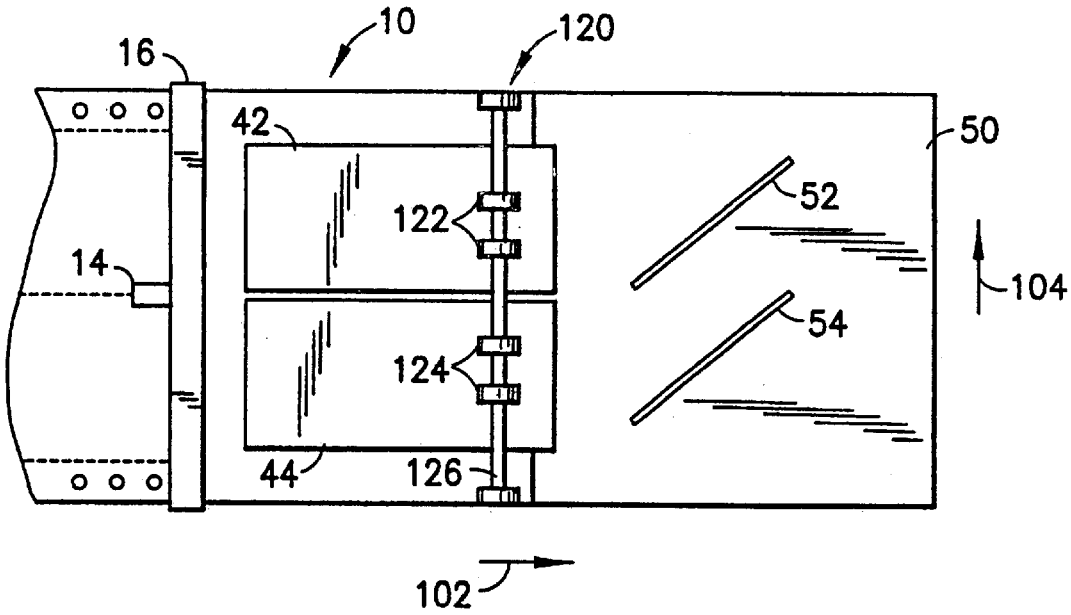
FIG. 5*b* is a diagrammatic representation showing the top view of the web cutter and part of the movement mechanism.

Referring to FIG. 5*a*, the sheets 42, 44 are moved from the web cutter 10 to the right angle transport device 50 by a group of rollers collectively denoted by reference numeral 120 and a movement mechanism 130. As shown in FIG. 5*b*, the roller group 120 includes two sets of rollers: one set of idler rollers 122 for moving the sheet 42 and another set of idler rollers 124 for moving the sheet 44. The rollers 122 and 124 can be mounted on a common shaft 126, or on different shafts, if so desired. Furthermore, additional moving devices 72 and 74 may be used to move the sheets 42, 44 while they are engaged with the right angle transport device 10.

Figure 6A:
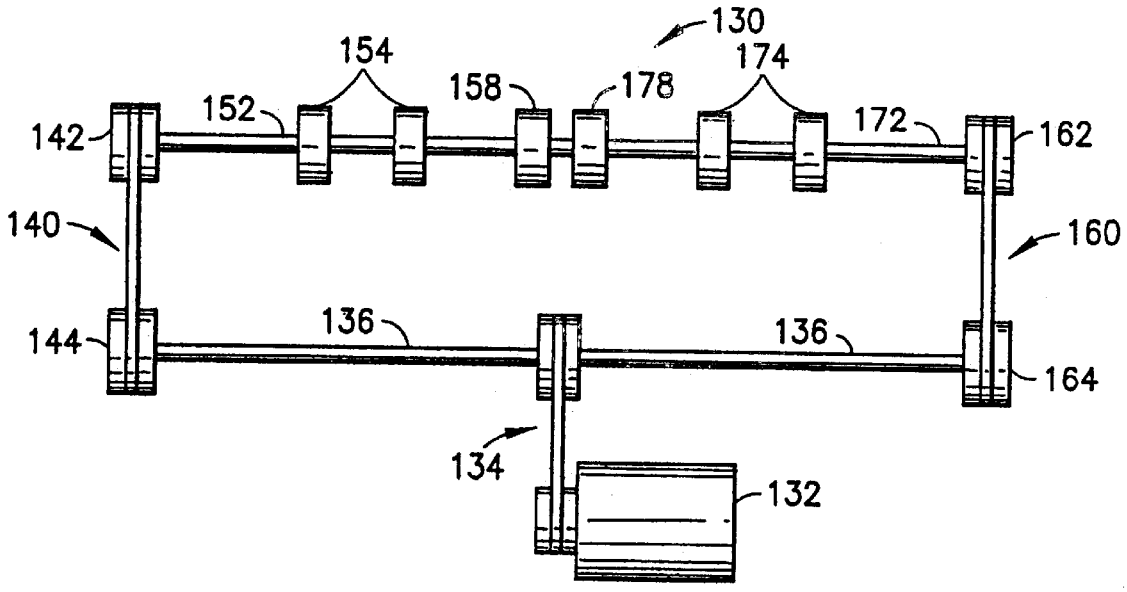
FIG. 6*a* is a diagrammatic representation showing a preferred embodiment of the movement mechanism, according to the present invention.
Figure 6B:
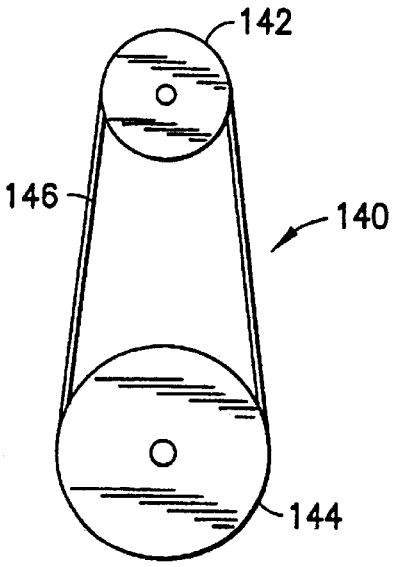
FIG. 6*b* is a diagrammatic representation showing a pulley system for moving one of the sheets toward the right angle transport device.
Figure 6C:
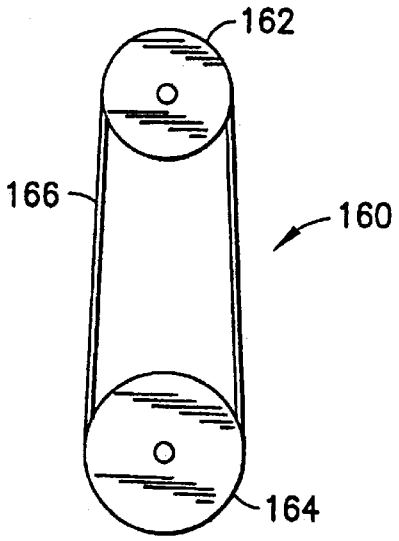
FIG. 6*c* is a diagrammatic representation showing a different pulley system for moving the other sheet toward the right angle transport device.

FIG. 6*a* illustrates the preferred embodiment of the moving mechanism 130, according to the present invention. As shown in FIG. 6*a*, the movement mechanism 130 includes two sets of rollers 174 and 154, corresponding to the idler rollers 122 and 124. The rollers 154 are fixedly mounted on a shaft 152 and a shaft mount 158. The rollers 174 are fixedly mounted on a shaft 172 and a shaft mount 178. The rollers 154 are driven by a pulley system 140, and the rollers 174 are driven by another pulley system 160. Preferably, the pulley systems 140,160 are driven by a motor 132 via a pulley system 134 and a common shaft 136. In order to achieve different driving speeds on rollers 154 and 174, it is possible to apply different mechanical advantages on the pulley systems 140 and 160. For example, different mechanical advantages can be achieved by using pulleys of different diameters. As shown in FIGS. 6*b* and 6*c*, the pulley system 140 includes a pulley 142, which is driven by a pulley 144 via a belt 146, and the pulley system 160 includes a pulley 162, which is driven by a pulley 164 via a belt 166. The diameter differential between the pulleys 144 and 142 is greater than the diameter differential between the pulleys 164 and 162. Because the pulleys 144 and 164 are driven by the same motor 132, the larger diameter differential on the pulley system 140 causes the rollers 154 to turn faster than the rollers 174 (FIG. 6*a*). Accordingly, the sheet 44 is moved toward the sheet turn-over module 54 with a greater speed than the sheet 42 being moved toward the sheet turn-over module 52.

Figure 7:
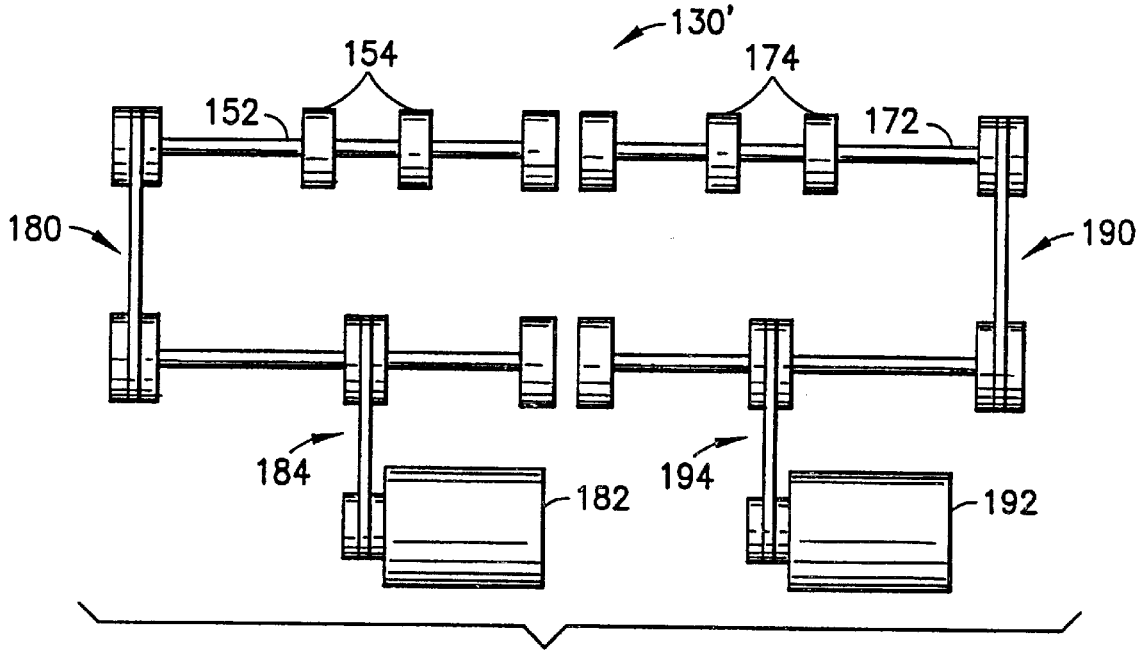
FIG. 7 is a diagrammatic representation showing a different embodiment of the movement mechanism, according to the present invention.

Alternatively, separate motors can be used to move the sheets 42, 44. As shown in FIG. 7, the rollers 154 are driven by a motor 182 via pulley systems 180, 184, and the rollers 174 are driven by a different motor 192 via pulley systems 190, 194. If the motor 182 is faster than the motor 192, then the pulley systems 180, 190 can be identical, and the pulley systems 184, 194 can be identical.

Figure 8A:
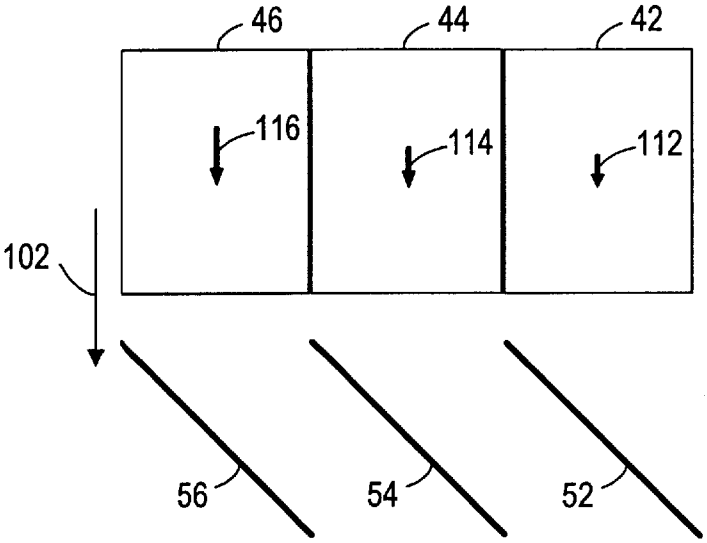
FIG. 8*a* is a diagrammatic representation showing more than two sheets may be moved toward a right angle transport device having three turn over modules.
Figure 8B:
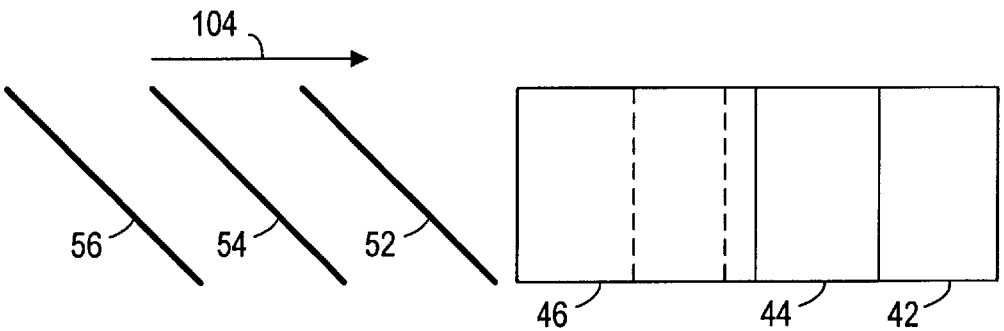
FIG. 8*b* is a diagrammatic representation showing three overlapped sheets as they emerge from the right angle transport device.

The movement mechanism, as described in conjunction with FIGS. 5*a* to 6*c*, uses different mechanical advantages in pulley systems to achieve different driving speeds to move the sheets 42, 44 in the web cutter 10. It is understood by those skilled in the art that there are numerous ways to achieve different driving speeds. For example, instead of using pulley systems 140 and 160, as shown in FIGS. 6*a* to 6*c*, it is possible to use gear systems to achieve different driving speeds. Furthermore, it is possible to stack three or more sheets in a sheet accumulation system with an increased overlapped amount, as shown in FIGS. 8*a* and 8*b*. As shown in FIG. 8*a*, three separate sheets 42, 44, 46 are moved in a side-by-side fashion along the moving direction 102 toward three sheet turn-over modules 52, 54, 56. With different moving speeds 112,114 and 116, the sheets 42, 44, 46 can be caused to overlap with each other with an increased overlapped amount, as shown in FIG. 8*b*.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A continuous web cutter for cutting a web of material into groups of cut sheets, wherein each group of cut sheets comprises at least a first sheet and a second sheet, and wherein the first and second sheets are moved side-by-side from the web cutter toward a right angle transport device for causing the first and second sheets to turn over and change moving direction from a first direction to a second direction substantially perpendicular to the first direction, with the first sheet leading the second sheet in an overlapping manner having an overlapped amount in the second direction, said web cutter comprising:

a first movement mechanism for moving the first sheet toward the right angle transport device with a first moving speed, and a second movement mechanism for moving the second sheet toward the right angle transport device with a second moving speed greater than the first moving speed for increasing the overlapped amount.

2. The web cutter of claim 1, further comprising a motor for driving the first movement mechanism and the second movement mechanism, wherein the first movement mechanism comprises at least one roller driven by a first pulley system for moving the first sheet, and the second movement mechanism comprises at least one roller driven by a second pulley system for moving the second sheet, and wherein the first pulley system provides the first moving speed with a first mechanical advantage, and the second pulley system provides the second moving speed with a second mechanical advantage greater than the first mechanical advantage.

3. The web cutter of claim 1, wherein the first movement mechanism comprises at least one roller driven by a first motor to move the first sheet with the first moving speed and the second movement mechanism comprises at least one roller driven by a second motor to move the second sheet with the second moving speed.

4. A method of stacking sheets in a sheet accumulating system including:

a right angle transport device to change moving direction of sheets from a first direction to a second direction substantially perpendicular to the first direction; and a continuous web cutter for cutting a web of material into groups of cut sheets, wherein each group of cut sheets comprises at least a first sheet and a second sheet, and wherein the first and second sheets are moved substantially in a parallel fashion along the first direction from the web cutter toward the right angle transport device for causing the first and second sheets to turn over and move along the second direction with the first sheet leading the second sheet in an overlapping fashion having an overlapped amount in the second direction, said method comprising the steps of:

providing a first movement mechanism for moving the first sheet with a first moving speed, and providing a second movement mechanism for moving the second sheet with a second moving speed greater than the first moving speed for increasing the overlapped amount.

5. The method of claim 4, wherein a motor is used to drive the first movement mechanism and the second movement mechanism, and wherein the first movement mechanism comprises at least one roller driven by a first pulley system for moving the first sheet, and the second movement mechanism comprises at least one roller driven by a second pulley system for moving the second sheet, and wherein the first pulley system provides the first moving speed with a first mechanical advantage, and the second pulley system provides the second moving speed with a second mechanical advantage greater than the first mechanical advantage.

6. The method of claim 5, wherein the first movement mechanism comprises at least one roller driven by a first motor to move the first sheet with the first moving speed and the second movement mechanism comprises at least one roller driven by a second motor to move the second sheet with the second moving speed.

7. A sheet accumulating system comprising:

a right angle transport device to change the moving direction of sheets from a first direction to a second direction substantially perpendicular to the first direction;

a continuous web cutter for cutting a web of material into groups of cut sheets, wherein each group of cut sheets comprises at least a first sheet and a second sheet, and wherein the first and second sheets are moved along the first direction from the web cutter toward the right angle transport device for causing the first and second sheets to turn over and move along the second direction with the first sheet leading the second sheet in an overlapping manner having an overlapped amount in the second direction;

a first movement mechanism for moving the first sheet with a first moving speed, and a second movement mechanism for moving the second sheet with a second moving speed greater than the first moving speed for increasing the overlapped amount.

* * * * *